United States Patent [19]

Bader et al.

[11] Patent Number: 4,732,503

[45] Date of Patent: Mar. 22, 1988

[54] RESERVOIR FLUID DISPENSER WITH CONTROL VALVE

[75] Inventors: Peter Bader, Minneapolis, Minn.; Dennis A. Gross, Lake Forest; Robert M. Barrett, Rolling Meadows, both of Ill.; Wayne M. Bekius, Milaca, Minn.

[73] Assignee: Wagner Spray Tech Corporation, Minneapolis, Minn.

[21] Appl. No.: 894,361

[22] Filed: Aug. 7, 1986

[51] Int. Cl.[4] ..... B05C 1/10

[52] U.S. Cl. ..... 401/197; 401/140; 401/176; 401/187; 401/189; 401/203; 401/207; 141/2; 141/20.5

[58] Field of Search ..... 401/197, 144, 182, 187, 401/189, 203, 140, 188, 207; 141/2, 20.5, 348–350, 18; 222/387, 452, 309

[56] References Cited

U.S. PATENT DOCUMENTS

| | | | |
|---|---|---|---|
| 4,927 | 1/1847 | Hunt . | |
| D. 231,131 | 4/1974 | Osborne-Design . | |
| 406,128 | 7/1889 | Dixon et al. . | |
| 716,910 | 12/1902 | Lubbecke | 222/387 |
| 718,417 | 1/1903 | Blake et al. . | |
| 954,260 | 4/1910 | Davis . | |
| 964,982 | 7/1910 | Lewinson . | |
| 1,001,617 | 8/1911 | Cardinet . | |
| 1,134,865 | 4/1915 | Jones . | |
| 1,207,121 | 12/1916 | Zeidler . | |
| 1,268,271 | 6/1918 | Nelson . | |
| 1,393,133 | 10/1921 | Jarusz . | |
| 1,605,133 | 11/1926 | Moroney | 222/309 |
| 1,618,930 | 4/1926 | Istrico . | |
| 1,711,516 | 5/1929 | Alland . | |
| 1,970,851 | 8/1934 | Harbison . | |
| 2,148,236 | 2/1939 | Hanle . | |
| 2,274,790 | 3/1942 | Housley . | |
| 2,514,225 | 7/1950 | Dabrohua | 401/136 |
| 2,547,834 | 5/1945 | Perwas . | |
| 2,669,739 | 2/1954 | Winberg | 401/7 |
| 2,964,769 | 12/1959 | Mercereau . | |
| 3,175,242 | 7/1963 | Kamondy et al. . | |
| 3,231,151 | 11/1963 | Clark et al. . | |
| 3,236,268 | 4/1963 | Simpson . | |
| 3,236,889 | 10/1964 | Fortune . | |
| 3,286,297 | 1/1964 | MacFarland . | |
| 3,337,899 | 8/1965 | Rentfrow . | |
| 3,393,854 | 8/1966 | Fortune . | |
| 3,457,017 | 3/1966 | Bastian . | |
| 3,519,364 | 2/1968 | Truhan . | |
| 3,554,659 | 3/1968 | Stokes . | |
| 3,612,707 | 10/1971 | Herbrechter et al. . | |
| 4,074,944 | 2/1978 | Xavier . | |
| 4,415,288 | 11/1983 | Gordon et al. . | |
| 4,535,304 | 5/1924 | Gerdin . | |
| 4,584,733 | 4/1986 | Tietge et al. . | |
| 4,695,176 | 9/1987 | Simonette | 401/197 X |

FOREIGN PATENT DOCUMENTS

| | | | |
|---|---|---|---|
| 256655 | 5/1963 | Australia | 401/139 |
| 1334210 | 6/1963 | France . | |
| 2148154 | 5/1985 | United Kingdom . | |

*Primary Examiner*—Richard J. Apley
*Assistant Examiner*—F. Gubernick
*Attorney, Agent, or Firm*—Hill, Van Santen, Steadman & Simpson

[57] ABSTRACT

An apparatus for applying a liquid to a surface comprising an applicator and a body member. The applicator is secured to an end of the body member, the body member defining a reservoir for housing a fluid. The body member includes a piston member for exerting a force on the fluid in the reservoir, and two channels, a first channel being in fluid communication with a channel in the applicator and a second channel being in fluid communication with an area outside the body member. The body member further including a valve for allowing fluid communication between the reservoir and either the first channel or second channel. An additional one-way valve which can be manually deactivated may be included in the second channel.

18 Claims, 6 Drawing Figures

RESERVOIR FLUID DISPENSER WITH CONTROL VALVE

BACKGROUND OF THE INVENTION

This invention relates generally to apparatus for dispensing and applying liquid or like materials. Specifically, the present invention relates to a self-contained paint roller for applying paint to a surface.

There are a variety of different apparatus that have been developed for dispensing a fluid or other substance so that it can be applied to a surface. This is especially true in the paint and paint supply area. Perhaps in their simplest form, paint supplies typically comprise a brush, roller, and tray for containing the paint so that it can be transferred to the paint roller.

Due to the inherent nature of paint, the use of a roller and roller tray can be messy even for professional painters. This is due to the fact that there are many instances during the painting process in which paint can either be spilled or dripped onto the floor or other surfaces. For example, paint can be spilled when it is transferred to the paint tray or roller and when the roller is moved from the roller tray to the surface to be painted. Of course, if too much paint is saturated in the roller the paint can drip out as the paint is supplied to the wall or surface to be painted.

Not only is the roller and paint tray painting system an inherently messy method of painting, it is also a burdensome and time consuming process. one must continuously saturate the roller with paint, accordingly, the painting procesure is continually interrupted so that the roller can be rolled in the paint tray. This requires one to constantly bend over and roll the roller in the paint tray so that it can be coated with paint.

There have been various attempts to improve the roller and paint tray system to provide a more efficient and cleaner system. Recently, paint rollers connected to pumps that directly pumped the paint to the paint roller have been utilized. To this end, a flexible tube is located within the paint reservoir, or connected to a conduit located in the paint reservoir, and is connected to a pump that pumps the paint from the paint reservoir directly into the roller.

Although, these apparatus provide a more efficient paint roller in that the paint supply is automatically supplied to the roller, deleting the necessity for saturating the roller every couple of minutes, these systems are typically more expensive than hand rollers.

Another solution to the problems posed by traditional roller and paint trays has been to construct the dispensing device so that it is self-contained. To this end, the device contains a reservoir in its handle that can be filled with a liquid and thereby provides an apparatus that has its own selfcontained paint supply. For example, U.S. Pat. No. 3,337,899 to Rentfrow discloses a roller type paint dispenser utilizing a piston and elongated cylinder construction. A valve is located on the outside of the elongated tube allowing one to threadily connect the valve to a tube disposed within a paint can reservoir. The piston member is then withdrawn causing paint to be sucked into the reservoir defined by the elongated tube. After the paint is drawn into the elongated tube, the valve member is closed and one can begin painting.

Similar type roller constructions with a reservoir and some sort of piston arrangement are illustrated in U.S. Pat. No. 3,612,707 (Herbrechter), U.S. Pat. No. 3,554,659 (Stokes), and U.S. Pat. No. 2,964,769 (Mercereau). This concept is also illustrated in U.S. Pat. No. 1,535,304 (Gerdin) for a window cleaning device. The advantage of such a system is that it allows one to fill the paint roller from the paint reservoir without the need for a flexible tube being constantly connected to the paint roller.

Although, the use of a plunger and the elongated tube provides a neat and easy method of filling a reservoir so that one may apply the paint or a liquid to a surface, when paint is utilized special problems must be addressed. As illustrated in Rentfrow, it is desirable to have some sort of filler mechanism so that paint may be sucked into the elongated reservoir. However, this must be tempered with the concern that once paint is sucked into the reservoir it should not be able to exit the reservoir through the filler opening. Accordingly, it is desirable that the reservoir is automatically sealed off by a valve so that if one forgets to close the valve and attempts to paint with the roller, paint is not shot all over the carpet or furniture because a valve is open.

Moreover, it is desirable for the apparatus to provide a means for returning the excess paint contained in the elongated tube to the paint can or reservoir after the painting chore is finished. This is a contradictory goal vis-a-vis the goal of closing the valve after the paint is sucked into the reservoir, i.e., you want to be able to return unused paint but ensure that the valve cannot be inadvertantly left open.

Furthermore, the apparatus must provide an easy method for cleaning the paint roller and reservoir. For example, it is desirable to allow one to be able to clean out the reservoir by sucking liquid into the reservoir and pushing it out repeatedly. Again, this is contradictory to the need of preventing the accidental spraying of paint through the valve.

In summary, there is a need for a paint roller construction wherein: (1) paint is allowed to be sucked into a reservoir but is prevented from accidentally being sprayed through an aperture that allows paint to enter the reservoir; (2) one can empty the paint from the reservoir into a can or other dispensing means; and (3) one can force liquid in and out of the paint roller. These contradictory needs have not been addressed by a self-contained paint roller.

Accordingly, there is a need for an improved apparatus for applying paint to a wall, ceiling or other surface.

SUMMARY OF THE INVENTION

The present invention provides an apparatus for applying a liquid to a surface comprising an applicator and a body member, the applicator being secured to an end of the body member and the body member defining a reservoir for housing a fluid. The body member includes a piston means for exerting a force on the fluid in the reservoir. The body member further includes two channels, a first channel being in fluid communication with a channel in the applicator and a second channel being in fluid communication with an area outside the body member. The body member further includes a first valve that allows fluid communication only between the reservoir and either the first channel or the second channel.

In a first embodiment, the valve is manually rotatable to a first position wherein fluid communication between the reservoir and first channel is established and a second position wherein fluid communication between the second channel and reservoir is established. In this embodiment, preferably, the body member includes a one-way valve between the valve and a filling port in fluid communication with the area outside the body member. The body member also includes means for deactivating the one-way valve. Preferably the one-way valve is spring biased into the channel between the aperture and the valve and accordingly may be biased inwardly by a button member so that fluid communication can be established between the reservoir and the filling port.

In a second embodiment, the valve member is spring biased so that it allows fluid communication between the first channel and reservoir but prevents fluid communication between the reservoir and second channel the body member includes means for causing fluid communication between the second channel and reservoir. Preferably the body member includes a button member on its exterior side. By urging the button member inward the valve is moved to a second position wherein fluid communication between the second channel and reservoir is established. Once the button member is released the valve automatically is biased back preventing fluid communication between the reservoir and second channel.

The apparatus for applying liquid provides a means for sucking a liquid into the reservoir through the filling port and the second channel. Once the fluid has been sucked into the reservoir the apparatus provides a safety that prevents the accidental expulsion of liquid through the filling port. To this end, in the second embodiment, the valve automatically is biased back once the button is released. In the first embodiment even if the first valve is in the second position, i.e. fluid communication is established between the reservoir and second channel, the one way valve will prevent fluid flow from the reservoir to the aperture.

In the first embodiment, once the valve is rotated to the first position so that fluid communication is established between the reservoir and applicator, the painting process can begin. Once the process is overpaint can be emptied back into the paint container by rotating the valve to the second position so that fluid communication is established between the second channel and the reservoir and pushing the button inward so that the one-way valve is biased outwardly from the channel and fluid communication is established. However, once the button member is released the one-way valve will be biased back into the channel so that liquid cannot be sprayed out of the filling port accidentially. Similarly, when one wishes to clean the reservoir by forcing liquid in and out of the elongated tube, one merely holds in the button while sticking one end of a conduit, the other end of which is received in the filling port, into a solvent or other cleaning material that is to be sucked into and pushed out of the reservoir.

Likewise, the second embodiment also provides an easy to fill and clean paint roller. To clean the reservoir or empty paint the button must be urged inwardly affording fluid communication between the reservoir and second channel. Once the button is released the valve is automatically biased to the painting position, i.e., fluid communication is established between the first channel and reservoir.

DETAILED DESCRIPTION OF THE PRESENTLY PREFERRED EMBODIMENTS

Figure 1:
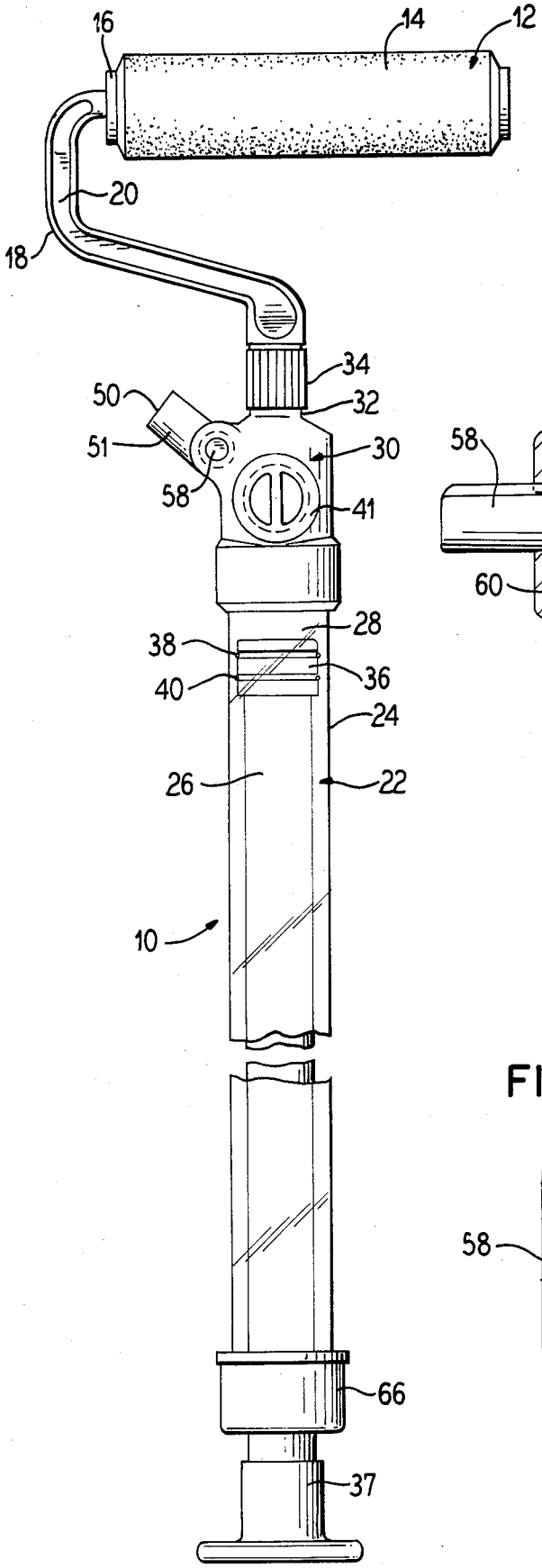
FIG. 1 illustrates a perspective view of a first embodiment of the apparatus of the present invention.

The present invention provides a paint roller that includes a self-contained paint supply. A reservoir in the paint roller can be easily filled yet the roller provides a means for preventing the accidental expulsion of paint through the filling port. Moreover, the paint roller provides a means for emptying the roller and cleaning the paint roller.

Referring to FIGS. 1–4, a first embodiment of the paint roller 10 of the present invention is illustrated. The paint roller 10 includes a roller 12 that has a porous sleeve 14, a tubular member 16, and a support frame 18. The support frame 18 includes a channel 20. The tubular member 16 includes apertures (not shown) for allowing paint that flows through the channel 20 in the support frame 18 to saturate the sleeve 14. Such rollers 12 are known in the art and any such roller can be utilized in the present invention that allows paint to be received through the channels 20 so that it saturates the roller sleeve 14.

The paint roller 10 further includes a body member 22. The body member 22 includes an elongated tube 24 and a piston means 26. The elongated tube 24 defines a reservoir 28 for containing a liquid to be dispensed to the roller 12. As discussed in greater detail below, the piston means 26 functions to exert a pressure on the fluid contained within the reservoir 28.

The body member 22 further includes a molded end 30 that includes means for securing the roller 12 to the body member 22. To this end, the molded end 30 includes a threaded end 32 that cooperates with a sleeve 34 so that the roller 12 may be removably secured to the body member 22. Of course, other means may be utilized for securing the roller 12 to the body member 22. A portion of the elongated tube 24 is also received in and secured to the molded end 30.

As previously stated, the elongated tube 24 defines a reservoir 28 for containing a fluid such as paint that is to be dispensed to the roller 12 and the piston means 26 is constructed so that it exerts a force on the fluid contained within the reservoir 28. To this end, the piston means includes an elongated portion that terminates at one end in a piston head 36 and at another end in a handle 37. The piston means 26 further includes O-rings 38 and 40 that ensure that a fluid-tight seal is created between the piston head 36 and the interior of the elongated tube 24. As discussed in detail below, this allows one to either suck a fluid into the reservoir 28 or force a fluid out of the reservoir 28 by urging the piston means 26 toward or away from the molded end 30.

Figure 2:
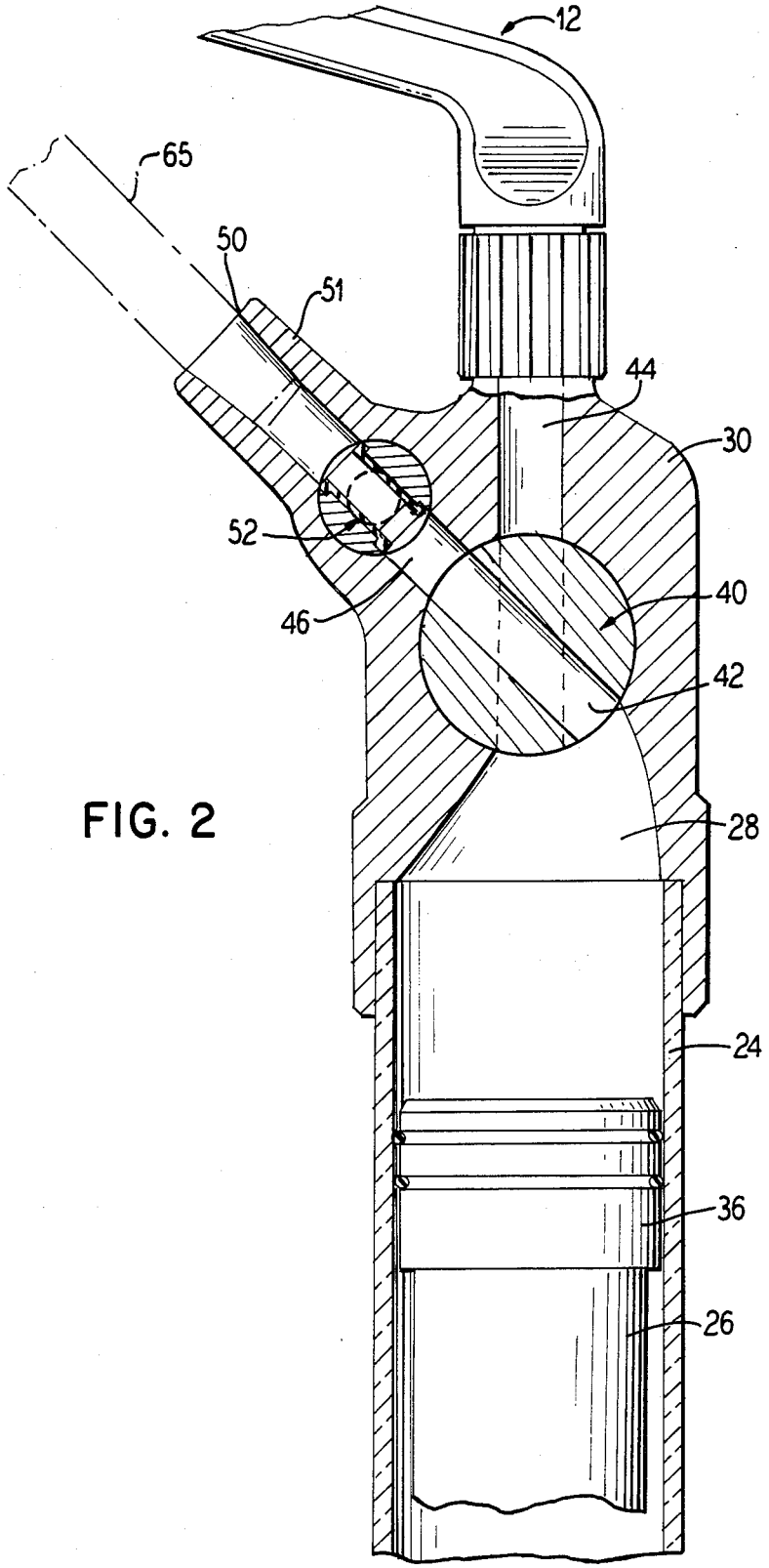
FIG. 2 illustrates a cross-sectional view of a portion of the first embodiment of the apparatus for applying paint.

Referring now to FIG. 2, the molded end 30 includes a valve means 40. As discussed in more detail below, the valve means 40 functions to allow one to either supply paint to the roller 12 or to suck paint into the reservoir 28. Accordingly, the valve means 40 includes a channel 42 that is rotatable to a first or a second position. In the first position the channel 42 is in fluid communication with the reservoir 28 and a first channel 44. In the second position the channel 42 is in fluid communication with the reservoir 28 and as second channel 46.

As illustrated in FIG. 1, located on an outer surface of the molded end 30 is a rotatable handle 41. The rotatable handle is secured to the valve 40 and accordingly allows one to rotate the valve to the first or second position. Preferably, the molded end 30 and handle 41 will have indices to indicate to the user when the valve 40 is in the first or second position.

As stated above, when the valve 40 is in the first position, the reservoir 28 is in fluid communication with the first channel 44. Because, as illustrated in FIG. 2, the channel 44 is in fluid communication with the roller 12, in the first position the reservoir 28 is in fluid communication with the channel 20 in the frame member 18. Accordingly, when the valve 40 is in the first position fluid can be forced from the reservoir 28 into the roller 12 by urging the piston 26 into the elongated tube 24. This is the painting position for the paint roller 10. In this position, fluid can flow from the reservoir 28 into the roller 12, but, however, cannot enter the channel 46.

The molded end 30 also includes an extending portion 51 that includes a filling port 50. The channel 46 extends from the valve 40 to the filling port 50. Accordingly, as discussed in more detail below, when the valve 40 is in the second position this allows fluid to be sucked into the reservoir 28 and to be expelled from the reservoir without fluid entering the roller 12.

Figure 3:
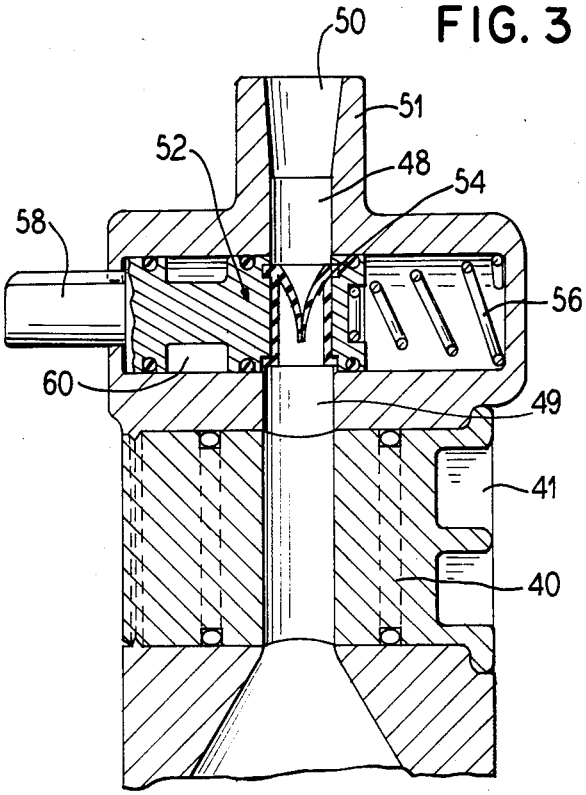
FIG. 3 illustrates a cross-sectional view of a portion of the apparatus for applying liquid.
Figure 4:
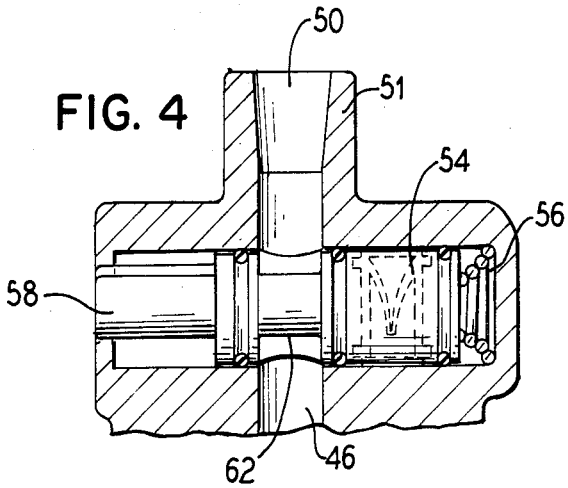
FIG. 4 illustrates the apparatus of FIG. 3 with the button in an actuated position.

Referring now to FIGS. 3 and 4, located within the channel 46 is a second valve means 52. The second valve means 52 divides the channel 46 into an outer channel 48 and an inner channel 49. The second valve means includes a one-way valve 54 that prevents fluid flow from the inner channel 49 into the outer channel 48. To this end, preferably, the one-way valve 54 comprises a flap valve. Of course, any other one-way valve known in the art may be utilized, (e.g. a spring biased check valve) to close off and prevent fluid flow from the channel 49 to the channel 48. Accordingly, the one-way valve 54 allows fluid flow through the filling port 50 and outer channel 48 and into the inner channel 49 but not vice versa. As discussed in detail below, the one-way valve 52 provides a safety feature that allows the reservoir 28 to be filled with paint or other fluid but prevents the accidental expulsion of the fluid through the filling port.

The one-way valve 54 is spring-biased outwardly between the outer and inner channels 48 and 49 by a spring 56. In order to effect fluid flow through the inner channel 49 into the outer channel 48 a button 58 is provided that urges a second valve 60 between the outer channel 48 and inner channel 49. The second valve 60 includes a channel 62 that effects fluid communication between the inner channel 49 and outer channel 48. Accordingly, when the button 58 biases the spring 56 inwardly so that the second valve 60 is located between the inner channel 49 and outer channel 48 fluid can flow between the channels in either direction.

The second valve means 52 is constructed, however, so that when the button 58 is released the spring 56 biases the oneway valve 54 back between the channel 46 so that fluid can no longer flow from the inner channel 49 into the outer channel 48. As discussed in detail below, although this allows one to clean the paint roller 10 the valve 52 prevents one from accidentially leaving the channel open and spraying paint through the filling port 50.

As illustrated, the filling port 50 is designed to receive a conduit 65 that can be located in a liquid container (not illustrated). In use, the conduit 65 is received within the filling port and the valve 40 is rotated to its second position, i.e., the filling or cleaning position, the plunger means 26 is then pulled outwardly away from the molded end 30 causing a vacuum pressure in the reservoir 28. This vacuum pressure causes the liquid in the container, e.g. paint, to be sucked through the conduit 65, the aperture 50, and valves 52 and 40 and into the reservoir 28. Accordingly, by pulling the plunger 26 outwardly from the molded end 30 paint can be sucked into the reservoir 28 to provide a paint supply for the roller 12.

Preferably, the end of the elongated tube 24 includes a stop member 66 that cooperates with the piston head 36 to prevent the piston 26 from accidentally being pulled all the way out of the elongated tube 24 while it is being filled. To this end, the stop member 66 has an inner diameter that is smaller than the outer diameter of the piston head 36. However, preferably, the stop member 66 is constructed so that it is possible to remove the piston member 26 from the elongated tube 24. To this end, the stop member 66 can be threadily connected to the elongated tube 24 or may be connected by a slight tolerance so that it can be snapped off the end of the elongated tube 24.

Due to the construction of the second valve means 52 and specifically the one-way valve 54, after the conduit 65 is removed from the filling port 50 and one begins to paint even if the user forgets to rotate the valve 40 to the first position, i.e. the painting position wherein the first channel 44 is in fluid communication with the reservoir 28, the one-way valve prevents paint from being sprayed out of the filling port 50 all over furniture or other structures. Accordingly, the one-way valve 54 acts as a safety to prevent the inadvertent expulsion of paint through the filling port 50.

As stated above, once the reservoir 28 is filled with paint, the valve member 40 is then rotated to the first painting position so that fluid communication between the channel 44 and reservoir 28 is established. In this position, when the piston means 26 is urged into the elongated tube 24 pressure is exerted on the paint contained therein forcing the paint into the channel 20 in the frame 18 and thereby into the roller 12. This action saturates the roller sleeve 14 with the paint allowing one to apply the paint to a surface. As the paint in the roller 12 and thereby in the sleeve 14 is used, additional force is exerted on the piston means 26 forcing more paint into the roller 12 saturating the sleeve 14. Accordingly, a continual supply of paint can be supplied to the roller 12 without the need to roll the roller in a paint tray.

Moreover, once the paint within the reservoir 28 is exhausted the paint supply can easily be replenished by inserting the filling port 50 onto the conduit 65, rotating the valve 40 to the first position, i.e. the fill position, and then pulling the piston means 26 in a direction outwardly from the molded end 30. This provides a clean and easy method for painting a surface.

Once the painting chore is finished and paint is still contained within the reservoir 28 the paint can be redispensed back into the paint container. To this end, the piston means 26 is first urged outwardly from the molded end 30 causing whatever paint is contained with in the roller 12 and specifically in the channel 20 to be sucked back into the reservoir 28 and out of the channels 20 and 44. The valve member 40 is then rotated to the second position so that fluid communication between the channel 46 and reservoir 28 is effected. The conduit 65 is then inserted into the filling port 50 and into the container into which the paint is to be redispensed. In order to provide fluid flow from the inner channel 49 through the outer channel 48, the button member 58 is urged inwardly biasing the spring 56 inwardly and causing the second valve member 60 to be received in the position previously occupied by the one-way valve 52. Accordingly, the channel 62, in the second valve 60, is in fluid communication with the channels 49 and 48. Therefore, as the button 58 is continuously pressed and the piston means 26 is urged inwardly into the elongated tube 22 is forced through the conduit 65 and into the container.

Due to this construction, i.e. because the button member 58 must be continuously baised inward to allow fluid to flow from the inner channel 49 into the outer channel 48, it is very difficult for one to accidentially spray paint out the filling port 50. Accordingly, the button 58 provides an intentionally difficult position for one to dispense paint from the filling port 28 through the aperture 50.

In order to clean the paint roller 10, one simply inserts the conduit 65 into some sort of solvent or solution. The valve member 40 is turned to the second position and the button member 58 in urged inwardly. The piston means 26 is then slid toward and away from the molded end 30 causing the solvent or solution to be sucked into the reservoir 22 and forced out of the reservoir. This action provides a flow of liquid in and out of the reservoir 28 allowing the reservoir to be cleaned. The paint roller 10 can also be cleaned, if desired, by removing the roller 12 and sucking solvent or water through the channel 40 of the molded end 30.

Figure 5:
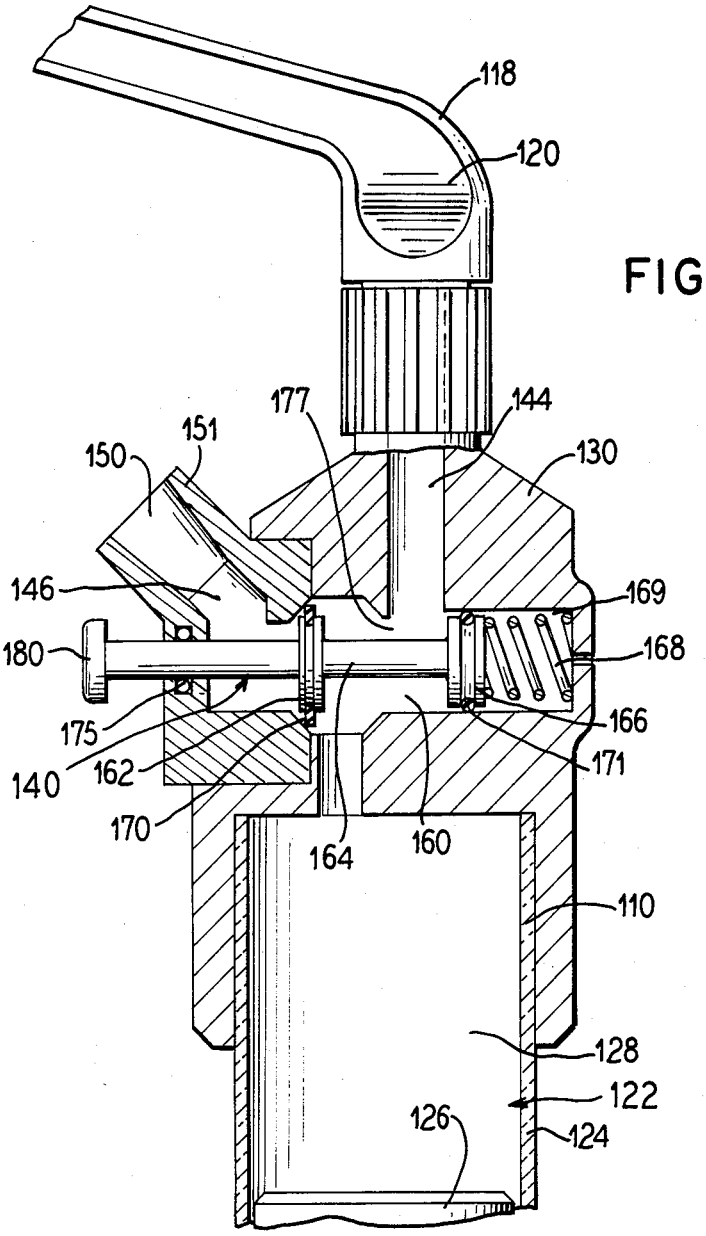
FIG. 5 illustrates a cross-sectional view of a second embodiment of the apparatus of the present invention.
Figure 6:
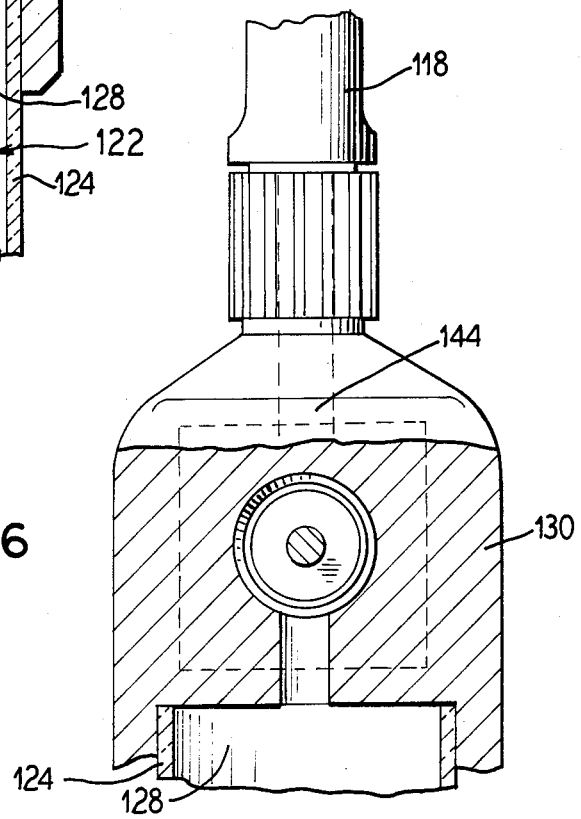
FIG. 6 illustrates a perspective view of a portion of the apparatus of FIG. 5.

Referring to FIGS. 5–6, a second embodiment of the paint roller 110 of the present invention is illustrated. As in the second embodiment, the paint roller 110 includes a roller (not shown) that has a porous sleeve, a tubular member, and a support frame 118. The support frame 118 includes a channel 120. The tubular member includes apertures for allowing paint that flows through the channel 120 in the support frame 118 to saturate the sleeve. As previously stated, such rollers are known in the art and any such roller can be utilized in the present invention.

The paint roller 110 further includes a body member 122. The body member 122 includes an elongated tube 124 and a piston means 126. The elongated tube 124 defines a reservoir 128 for containing a liquid to be dispensed to the roller. As discussed in the previous embodiment, the piston means 126 functions to exert a pressure on the fluid contained within the reservoir 128.

As in the first embodiment, the body member 122 further includes a molded end 130 that as previously stated includes means for securing the roller to the body member 122.

The molded end 130 includes a valve means 140. The valve means 140 functions to allow one to either supply paint to the roller or to suck paint into the reservoir 128. Accordingly, the valve 140 can be actuated to a first or a second position. In the first position, fluid communication between the reservoir 128 and a first channel 144 is established. In the second position, fluid communication between the reservoir 128 and a second channel 146 is established.

The valve 140 is located within a channel 160 in the molded head 130. The valve 140 includes a closure member 162, shaft 164, and end plug 166. The shaft terminates in the end plug 166 that is spring biased by a spring 168. The spring 168 is located in a chamber 169 in the molded head 130 and the end plug 166 includes an o-ring 171 to prevent liquid from entering the channel 169. The spring 168 biases the closure member 162 over an apertures 170 preventing fluid communication between the second channel 146 and reservoir 128.

Located at a second end of the shaft 164 is a button member 180 that allows one to urge the valve member 140 inward so that the closure member 162 now prevent fluid communication between the reservoir 128 and first channel 144. To this end, the closure 162 is urged against an aperture 177 at the opening of the channel 144. Once the button member 180 is released, fluid communication between the reservoir 128 and second channel 146 is prevented. This acts as a safety to prevent accidental expulsion through the filling port 150.

As in the previous embodiment, the filling port 50 is designed to receive a conduit (not illustrated) that can be located in a liquid container (not illustrated). In use, the conduit is received within the filling port 150 and the button 180 is urged inwardly caused the valve 140 to move to the second position, i.e., the filling or cleaning position, the plunger means 126 is then pulled outwardly away from the molded end 130 causing a vacuum pressure in the reservoir 128. This vacuum pressure causes the liquid in the container, e.g., paint, to be sucked through the conduit, the filling port 150 into the reservoir 128. Accordingly, by pulling the plunger 126 outwardly from the molded end 130 paint can be sucked into the reservoir 128 to provide a paint supply for the roller. As in the previous embodiment, the elongated tube 124 can include a stop member.

As stated above, once the reservoir 128 is filled with paint, the button member 180 is released and the valve 140 automatically moves to the first painting position so that fluid communication between the first channel 144 and reservoir 128 is established. In this position, when the piston means 126 is urged into the elongated tube 124 pressure is exerted on the paint contained therein forcing the paint into the channel 120 in the frame 118 and thereby into the roller. This action saturates the roller sleeve with the paint allowing one to apply the paint to a surface. As the paint in the roller and thereby in the sleeve is used, additional force is exerted on the piston means 126 forcing more paint into the roller saturating the sleeve 114. Accordingly, a continual supply of paint can be supplied to the roller without the need to roll the roller in a paint tray.

Moreover, once the paint within the reservoir 128 is exhausted the paint supply can easily be replenished by inserting the filling port 150 onto the conduit urging the button 180 in and causing the valve 140 to move to the second position, i.e. the fill position, and then pulling the piston means 126 in a direction outwardly from the molded end 130. This provides a clean and easy method for painting a surface.

Once the painting chore is finished and paint is still contained within the reservoir 128 the paint can be redispensed back into the paint container. To this end, the piston means 126 is first urged outwardly from the molded end 130 causing whatever paint is contained within the roller and specifically in the channel 120 to be sucked back into the reservoir 128 and out of the channels 120 and 144. The conduit is then inserted into the filling port 150 and into the container into which the paint is to be redispensed. The button member 180 is urged inwardly biasing the spring 168 inwardly and causing the valve 140 to be moved into the second piston. Therefore, as the button 180 is continuously pressed and the piston means 126 is urged inwardly into the elongated tube 124 paint is forced through the conduit and into the container.

Due to this construction, i.e. because the button member 160 must be continuously biased inward to allow fluid to flow from the reservoir 128 into the channel 146, it is very difficult for one to accidentally spray paint out the filling port 150. Accordingly, because the button 160 is so biased, the user will have to assume an intentionally difficult position to dispense paint from the reservoir 128 through the filling port 50.

Preferably the elongated tube 24 or 124 is constructed from a transparent material, such as transparent plastic so that the level of liquid within the reservoir 28 or 128 can be easily ascertained. Preferably the elongated tube 24 to 124 and piston means 26 or 126, as well as the molded end 30 or 130, are constructed from a high impact plastic. Of course, other materials may be utilized to construct the body member 22 or 122.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim as follows:

1. An apparatus for applying a liquid to a surface comprising:

an applicator;

a body member, the applicator being secured to an end of the body member, the body member defining a reservoir for housing a fluid;

a piston means for exerting a force on the fluid in the reservoir; and the body member including two channels, a first channel being in fluid communication with a channel in the applicator, a second channel being in fluid communication with an area outside the body member, the body member further including a single valve movable to a first or second position for establishing when the valve is in the first position fluid communication between the reservoir and the first channel and establishing when the valve is in the second position fluid communication between the reservoir and the second channel, the valve allowing, when fluid communication is established, fluid flow in both a first direction into the reservoir from the respective channel and fluid flow in a second direction out of the reservoir and into the respective channel.

2. An apparatus for applying a liquid to a surface comprising:

an applicator;

a body member, the applicator being secured to an end of the body member, the body member defining a reservoir for housing a fluid;

a piston means for exerting a force on the fluid in the reservoir; and the body member including two channels, a first channel being in fluid communication with a channel in the applicator, a second channel being in fluid communication with an area outside the body member, the body member further including a valve for allowing fluid communication between the reservoir and either the first channel or second channel, said second channel includes a one-way valve between said valve and an aperture in fluid communication with the area outside the body member, and said body member includes means for deactivating said one-way valve.

3. The apparatus of claim 2 wherein said one-way valve is spring baised outwardly.

4. The apparatus of claim 2 wherein the body member includes an accessible handle for rotating the valve to a first position wherein fluid communication between the first channel and reservoir is established and to a second position wherein fluid communication between the second channel and reservoir is established.

5. The apparatus of claim 4 wherein the body member includes a second valve in the second channel, the second valve being moveable to a first position wherein fluid flow from the reservoir to the area outside the body member is prevented and to a second position wherein fluid flow from the reservoir to the area outside the body member is established.

6. The apparatus of claim 5 wherein the second valve includes a spring biased button for moving the second valve to the first or second position.

7. The apparatus of claim 6 wherein the spring baises the second valve into the first position.

8. The apparatus of claim 2 wherein the valve is spring biased to a first position that allows fluid communication between the first channel and reservoir and prevents fluid communication between the second channel and reservoir.

9. The apparatus of claim 8 wherein the valve includes means for moving the valve to a second position so that fluid communication is established between then second channel and reservoir and the valve prevents fluid communication between the first channel and reservoir.

10. The apparatus of claim 9 wherein said means for moving is a button.

11. An apparatus for applying a liquid to a surface comprising:

an applicator;

a body member, the applicator being secured to an end of the body member, the body member defining a reservoir for housing a fluid;

a piston means for exerting a force on the fluid in the reservoir; and the body member includes two channels, a first channel being in fluid communication with a channel in the applicator, and a second channel terminating at an aperture in said body member, the body member further including a first valve means for effecting fluid communication between the first channel and reservoir or the second channel and reservoir, and a second valve for regulating the flow of liquid from the reservoir through the aperture in the body member, the second valve includes a one-way valve for preventing the flow of liquid from the reservoir through the aperture in the body member.

12. The apparatus of claim 11 wherein the one-way valve is spring biased into a first position wherein the one-way valve is located in the second channel and the second valve includes a means for urging said one-way valve to a second position out of the second channel.

13. The apparatus of claim 11 wherein the second valve includes means for allowing the flow of liquid from the reservoir through the aperture in the body member.

14. The apparatus of claim 11 wherein the first valve means is movable to a first position or to a second position and the body member includes an externally located handle for rotating the first valve means to the second position.

15. An apparatus for applying a liquid to a surface comprising:

an applicator;

a body member, the applicator being secured to an end of the body member, the body member defining a reservoir for housing a fluid;

a piston means for exerting a force on the fluid in the reservoir; and the body member includes two channels, a first channel being in fluid communication with a channel in the applicator, and a second channel terminating at an aperture on said body member, the body member including a spring biased valve, the spring biased valve being biased to a first position wherein fluid communication between the reservoir and first channel is established and fluid communication between the second channel and reservoir is prevented, preventing fluid flow through said aperture to an area outside the body member, the body member including means for causing said valve to move to a second position wherein fluid communication between the first channel and reservoir is prevented and fluid communication between the second channel and reservoir is established allowing fluid flow through said aperture to an area outside the body member.

16. An apparatus for applying a liquid to a surface comprising:

an applicator;

a body member, the applicator being secured to an end of the body member, the body member defining a reservoir for housing a fluid;

a piston means for exerting a force on the fluid in the reservoir; and the body member includes two channels, a first channel being in fluid communication with a channel in the applicator, and a second channel terminating at an aperture on said body member, the body member further including a spring biased valve, the spring biased valve being biased to a first position wherein fluid communication between the reservoir and first channel is established and fluid communication betweeen the second channel and reservoir is prevented, and including means for causing said valve to move to a second position wherein fluid communication between the first channel and reservoir is prevented and fluid communication between the second channel and reservoir is established, the means for causing said valve to move to the second position includes a button located on an external side of the body member.

17. The apparatus of claim 16 wherein the valve means includes a shaft having at one end the button, at a second end a plug member and a closure member located therebetween for preventing fluid communication between either the first or second channel and the reservoir.

18. The apparatus of claim 17 wherein the body member includes a third channel and the valve means is at least partially located within the channel.

* * * * *